United States Patent [19]

Prochaska

[11] Patent Number: 4,482,029

[45] Date of Patent: Nov. 13, 1984

[54] TRUCK LADDER

[76] Inventor: William J. Prochaska, Rt. 1, Box 161, Palmer, Nebr. 68864

[21] Appl. No.: 507,097

[22] Filed: Jun. 23, 1983

[51] Int. Cl.[3] ..... E06C 5/24

[52] U.S. Cl. ..... 182/96; 182/97; 182/206; 182/127

[58] Field of Search ..... 182/206, 97, 91, 159, 182/160, 161, 127

[56] References Cited

U.S. PATENT DOCUMENTS

| | | | |
|---|---|---|---|
| 104,569 | 6/1870 | Floyd | 182/161 |
| 420,143 | 1/1890 | Colbert | 182/206 |
| 1,232,221 | 7/1917 | Chesebro | 182/160 |
| 1,568,846 | 1/1926 | Jones | 182/97 |
| 1,606,445 | 11/1926 | Pirsch | 182/159 |
| 2,160,124 | 5/1939 | Cast | 182/161 |
| 2,508,915 | 5/1950 | Hardie | 182/159 |
| 3,503,467 | 3/1970 | Lindblad | 182/97 |
| 3,563,342 | 2/1971 | Lasiter | 182/97 |
| 3,722,622 | 3/1973 | Lauring | 182/159 |
| 3,989,122 | 11/1976 | Jenkins | 182/159 |

*Primary Examiner*—Reinaldo P. Machado

*Attorney, Agent, or Firm*—Zarley, McKee, Thomte, Voorhees & Sease

[57] ABSTRACT

A ladder for a truck box comprising a bracket assembly adapted to be placed over the upper edge of the truck box having a ladder assembly pivotally secured at its upper end to the bracket assembly so that the ladder assembly will remain vertically disposed regardless of the inclination of the truck box. The ladder assembly comprises an outer frame assembly pivotally connected to an inner frame assembly so that the outer frame assembly may be pivotally moved from an inoperative position closely adjacent the inner frame to an operative position wherein the outer frame is spaced outwardly of the inner frame. Steps pivotally interconnect the inner and outer frames.

1 Claim, 6 Drawing Figures

TRUCK LADDER

BACKGROUND OF THE INVENTION

This invention relates to a truck ladder and more particularly to a truck ladder which may be folded to an inoperative position and which always remains vertically disposed regardless of the inclination of the truck box. Grain trucks used for the transportation of grain normally have a hydraulically operated truck box which may be pivotally moved from a horizontal position to an inclined position so that grain may be dumped therefrom. It is frequently necessary for the driver to climb into the box or at least climb onto the side of the box to observe the grain therein. Ordinarily, the driver will step on the truck tire and then onto the box while grasping the box standards or the upper edge of the box. Such a procedure is not only dangerous but is difficult.

SUMMARY OF THE INVENTION

The ladder of this invention is designed to be used in conjunction with a truck box whether the truck box is in a horizontal position or in an inclined position. It is therefore an object of the invention to provide such a ladder which will remain vertically disposed whether the truck box is in the horizontal position or in an inclined position. A further object of the invention is to provide a truck ladder which may be stored in a substantially flat or collapsed condition when not in use and which may be folded outwardly to an operative position when the ladder is to be used. A bracket means engages the upper edge of the truck box and has the ladder assembly pivotally secured thereto. The ladder assembly comprises an inner frame which is pivotally secured to the bracket means. An outer frame assembly is pivotally connected to the inner frame assembly so that the outer frame assembly may be pivotally moved closely adjacent the inner frame assembly when the ladder is not being used.

It is therefore a principal object of the invention to provide a truck ladder which may be conveniently moved between operative and inoperative positions.

A further object of the invention is to provide a truck ladder which is not only convenient to use but which is safe to use.

These and other objects will be apparent to those having skill in the art.

DESCRIPTION OF THE PREFERRED EMBODIMENT

Figure 1:
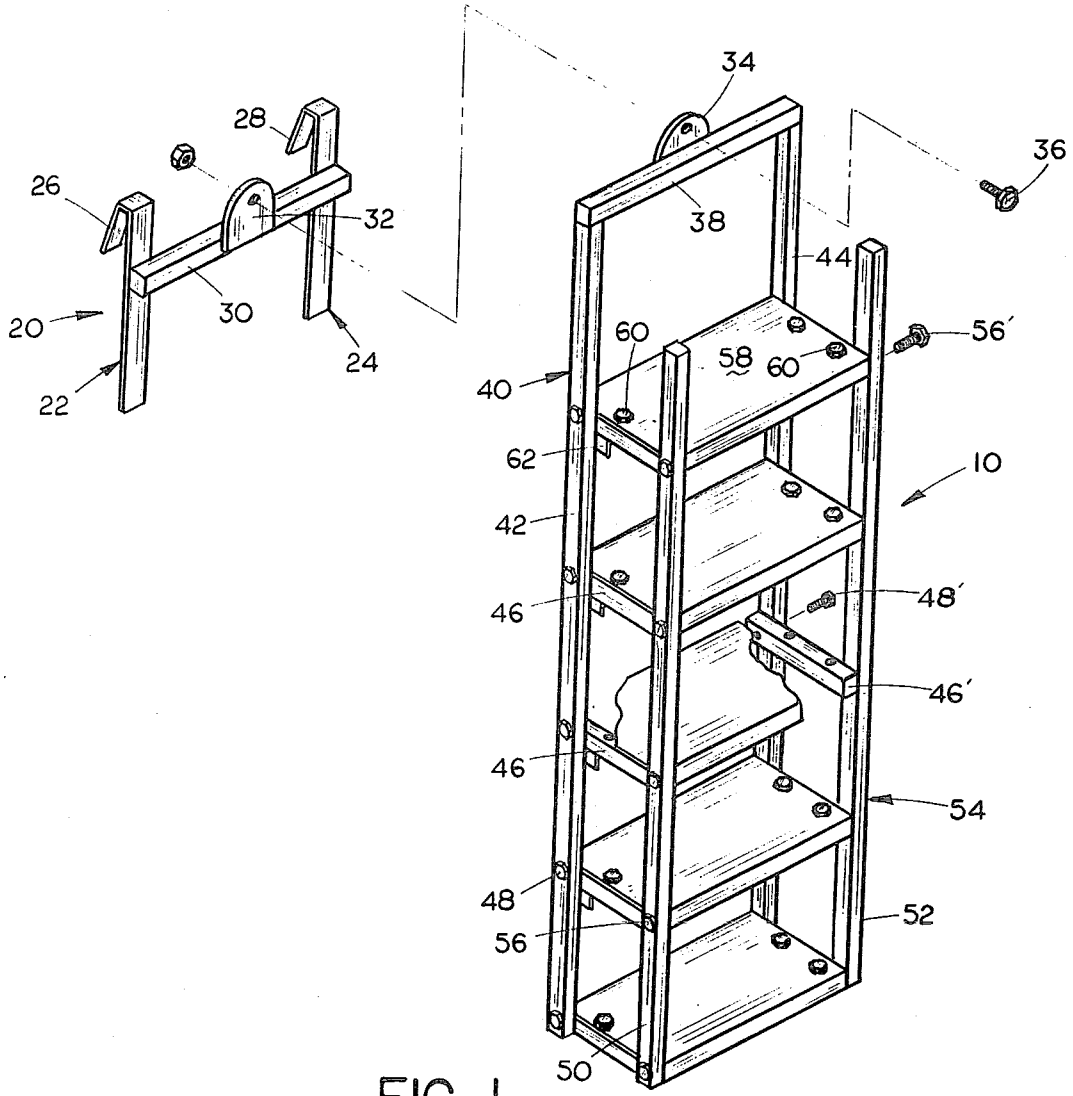
FIG. 1 is an exploded perspective view of the ladder of this invention.

The numeral 10 refers to the ladder of this invention while the numeral 12 refers to a conventional truck having a box 14 provided thereon. Box 14 includes a side wall 16 having an upper edge 18. Ladder 10 comprises a bracket means 20 including spaced-apart bracket members 22 and 24 having substantially inverted V-shaped hooks 26 and 28 at the upper ends thereof adapted to receive and embrace the upper edge 18. Bracket members 22 and 24 are positioned adjacent the outer surface of side wall 16 and have brace 30 secured thereto which extends therebetween.

Pivot plate 32 is welded to brace 30 and has pivot plate 34 pivotally secured thereto by bolt 36. As seen in the drawings, plate 34 is secured to upper frame member 38 of frame 40. Inner frame 40 includes frame members 42 and 44 in the form of square tubes which are welded to the opposite end of frame member 38 and which extend downwardly therefrom. A plurality of links in the form of square tubes 46 are pivotally connected at their inner ends to frame member 42 by bolts 48. Likewise, a plurality of links 46' are pivotally secured at their inner ends to frame member 44 by bolts 48'. Frame members 50 and 52 of outer frame 54 are pivotally connected to the outer ends of the links 46 and 46' by bolts 56 and 56'. Steps 58 are secured to and extend between the links 46 and 46' as seen in the drawings and are secured thereto by bolts 60. A plurality of stops or limiting members 62 are secured to frame members 42 and 44 and extend outwardly therefrom as seen in the drawings. Stops 62 are adapted to engage the undersides of the links 46 and 46' to limit the downwardly pivotal movement of the steps and outer frame 54.

Figure 2:
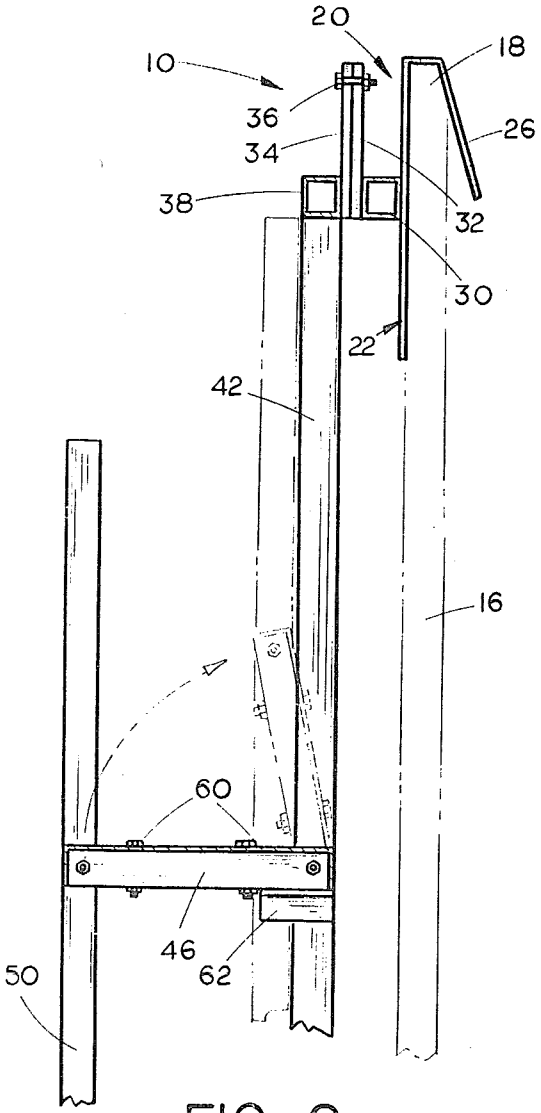
FIG. 2 is a partial side elevational view of the ladder with the phantom lines indicating the truck box and the alternate position to which the ladder may be pivoted.
Figure 3:
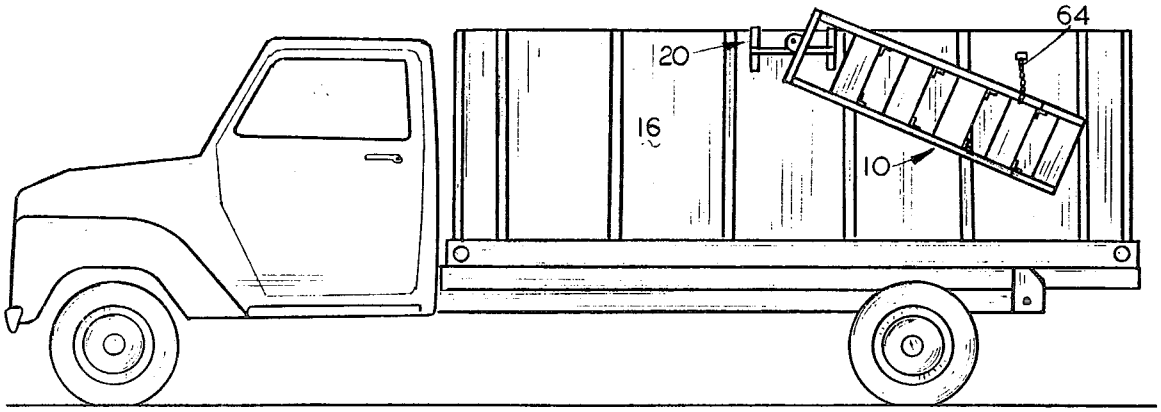
FIG. 3 is a side view of a truck having the ladder of this invention secured in an inoperative or transport position.
Figure 4:
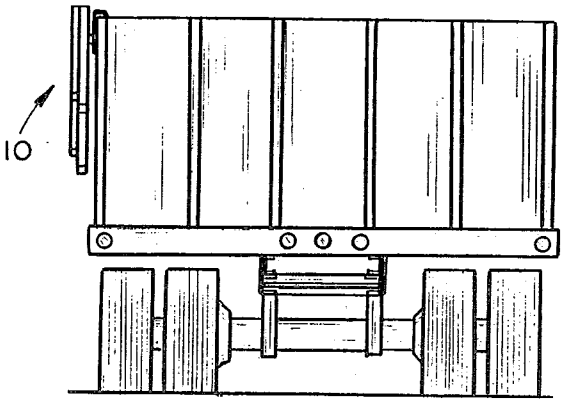
FIG. 4 is a rear view of the truck with the ladder positioned as in FIG. 3.

The ladder 10 of this invention is mounted on the box 10 as illustrated in the drawings so that the hooks 26 and 28 extend over and engage the upper edge of the box. It can be seen in the drawings that the engagement of the hooks 26 and 28 with the upper edge of the truck box will positively maintain the ladder in position and will prevent the ladder from moving either forwardly or rearwardly with respect to the box. When the ladder is not being used, outer frame 54 is pivotally moved upwardly and inwardly relative to inner frame 40 from the position of FIG. 1 to the position illustrated by solid lines in FIG. 4 and the position illustrated by broken lines in FIG. 2. When the outer frame 54 is pivotally moved upwardly and inwardly, it dwells closely adjacent the inner frame 40 so that the ladder will not objectionably protrude outwardly from the box.

Figure 5:
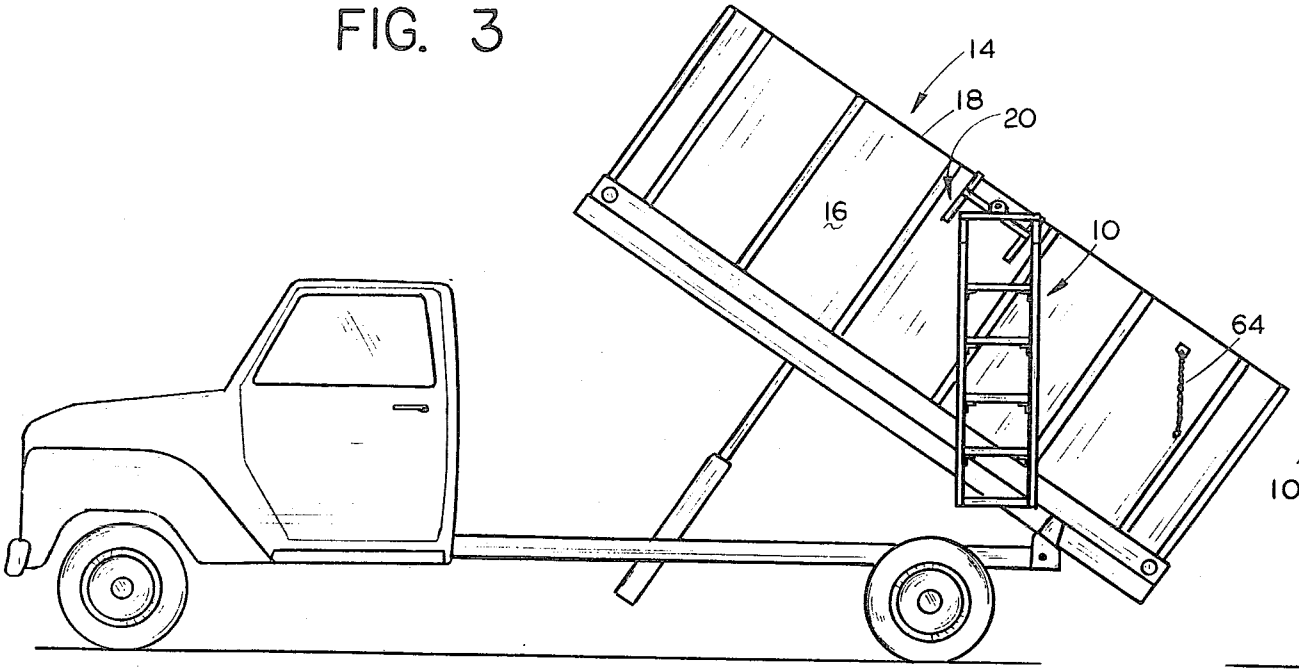
FIG. 5 is a view similar to FIG. 3 except that the truck box has been pivotally moved upwardly and the ladder has been moved to its operative position.
Figure 6:
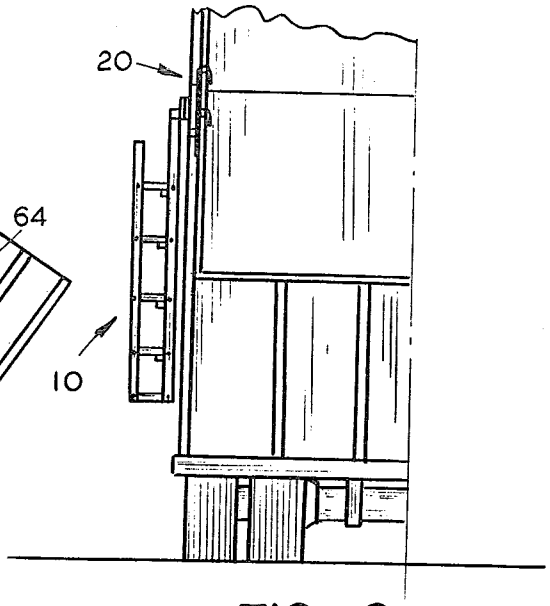
FIG. 6 is a rear view of the truck illustrating the ladder and the truck in the position of FIG. 5.

When the ladder is in the stored or inoperative position, it is recommended that it be pivoted upwardly and rearwardly and maintained in the inclined position by means of a chain and hook assembly 64. When it is desired to utilize the ladder, the chain and hook assembly 64 is unfastened and the ladder is permitted to swing to its vertically disposed condition. The outer frame 54 is then pivotally moved outwardly and downwardly relative to the inner frame 40 to the position illustrated in FIGS. 1 and 6. The ladder will remain in its vertically disposed condition regardless of the inclination of the box 14 as illustrated in FIG. 5. This is an important feature since the driver can gain access to the interior of the box by means of the ladder even though the box may be pivoted upwardly to the position of FIG. 5.

When the operator has completed the use of the ladder, the ladder would then again be pivoted to its inoperative position. It is recommended that some form of retaining means such as a resilient hook means or the like be employed to maintain the outer frame 54 adjacent the inner frame 40 when the ladder is in the inoperative position.

Thus it can be seen that the ladder of this invention accomplishes at least all of its stated objectives.

I claim:

1. In combination with a truck box having an upper edge, comprising, a ladder comprising a bracket means including a pair of spaced-apart bracket members which engage the upper outer surface of said box, said bracket members having inverted generally V-shaped hooks at the upper ends thereof which receive and engage the upper edge of the box, and a brace secured to and extending between said bracket members, said ladder also including an inner frame means, an outer frame means and step members operatively pivotally connecting said inner and outer frame means so that said outer frame means may be selectively moved from an inoperative position within said inner frame means, to an operative position outwardly of said inner frame means, said steps having an upper surface which is substantially horizontally disposed when said outer frame means is in its operative position, said inner frame means being pivotally secured at its upper end to said brace whereby said ladder will remain vertically disposed regardless of the inclination of the truck box and wherein said ladder may be pivotally moved to a storage position when said ladder is not being used, said inner frame means having a plurality of stops secured thereto which extend horizontally outwardly therefrom in the pivotal path of said steps to limit the movement of said outer frame means relative to said inner frame means to maintain said steps in a substantially horizontally disposed condition when said outer frame means is in its operative position.

* * * * *